US009261828B1

(12) United States Patent
Nishi

(10) Patent No.: US 9,261,828 B1
(45) Date of Patent: Feb. 16, 2016

(54) IMAGE FORMING APPARATUS, FIXING DEVICE AND FIXING BELT TEMPERATURE CONTROL METHOD WHICH DO NOT REQUIRE SUBJECTING A FIXING BELT TO A HEATING TEST

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Takayuki Nishi, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/448,130

(22) Filed: Jul. 31, 2014

(51) Int. Cl.
*G03G 15/20* (2006.01)

(52) U.S. Cl.
CPC ..... *G03G 15/2039* (2013.01)

(58) Field of Classification Search
USPC ..... 399/328, 329
See application file for complete search history.

(56) References Cited

U.S. PATENT DOCUMENTS 7,437,113 B2 * 10/2008 Suzuki et al. ..... 399/328
2012/0263510 A1 * 10/2012 Mita et al. ..... 399/329

* cited by examiner

*Primary Examiner* — Quana M Grainger
(74) *Attorney, Agent, or Firm* — Amin, Turocy & Watson, LLP

(57) ABSTRACT

A fixing device comprises a fixing belt heated through electromagnetic induction; a pressing roller; a plurality of temperature detection devices arranged along a width direction of the belt; and a control device consisting of a storage section and a control section and connecting with the detection devices and the heating device. The control section supplies a given output for the heating device when the belt is rotated initially, measures an initial temperature distribution of the belt on basis of a signal from the plurality of detection devices, and controls the output to the heating device on the basis of the initial distribution to control the initial distribution of the belt in a given range. The storage section stores the output control. The control section controls the output to the heating device based on the control stored in the storage section every time the belt is rotated after the initial rotation.

16 Claims, 6 Drawing Sheets

| | TEMPERATURE DETECTION DEVICE 42A | TEMPERATURE DETECTION DEVICE 42B | TEMPERATURE DETECTION DEVICE 42C | SET FIXING TEMPERATURE | ABNORMALITY DETECTION TEMPERATURE OF 42A AT ONE SIDE | ABNORMALITY DETECTION TEMPERATURE OF 42C AT OTHER SIDE | |
|---|---|---|---|---|---|---|---|
| FIG.5 | — | — | — | 185℃ | 210℃ | 210℃ | IDEAL STANDARD BELT |
| FIG.6 | HIGH | — | LOW | 170℃ | 200℃ | 210℃ | |
| FIG.7 | — | — | HIGH | 160℃ | 210℃ | 200℃ | |
| FIG.8 | HIGH | — | HIGH | 150℃ | 200℃ | 200℃ | |
| FIG.9 | LOW | — | LOW | 170℃ | 210℃ | 210℃ | |
| FIG.6 INVERTED IN WIDTH DIRECTION | LOW | — | HIGH | 170℃ | 210℃ | 200℃ | |
| FIG.7 INVERTED IN WIDTH DIRECTION | HIGH | — | — | 160℃ | 200℃ | 210℃ | |

"-" REPRESENTS TEMPERATURE SAME AS TEMPERATURE OF CENTRAL TEMPERATURE DETECTION DEVICE 42B

FIG.10

IMAGE FORMING APPARATUS, FIXING DEVICE AND FIXING BELT TEMPERATURE CONTROL METHOD WHICH DO NOT REQUIRE SUBJECTING A FIXING BELT TO A HEATING TEST

FIELD

Embodiments described herein generally relate to an image forming apparatus, a fixing device and a method for controlling the temperature of a fixing belt of the fixing device.

BACKGROUND

An image forming apparatus provided with a fixing device is well-known. The image forming apparatus forms an image on a medium such as paper or a plastic sheet with a coloring material such as ink or toner based on image information. Then the fixing device applies heat and pressure to the image on the medium to fix the image on the medium. The medium on which the image is fixed is discharged to a given position.

There are various types of fixing devices. In recent years, a type of fixing device has been used which includes a pressing roller and an endless fixing belt capable of generating heat through electromagnetic induction. Such a fixing belt is supported to be capable of moving annularly on a pressing roller. The fixing belt basically includes an inner substrate layer, a heat generation layer laminated around the outer peripheral surface of the substrate layer to generate heat through electromagnetic induction, and an elastic layer laminated around the outer peripheral surface of the heat generation layer.

A pressure pad is arranged at a part of the inner peripheral surface of the fixing belt adjacent to the pressing roller. The pressure pad presses the part of the outer peripheral surface of the fixing belt adjacent to the pressing roller against the outer peripheral surface of the pressing roller. An electromagnetic induction heating device is arranged adjacent to the outer peripheral surface of the fixing belt at a position far away from the pressing roller. A magnetic shunt member and a magnetic shielding member are arranged adjacent to the inner peripheral surface of the fixing belt at a position far away from the pressing roller.

In the electromagnetic induction heating type fixing device, the electromagnetic induction heating device heats the heat generation layer of the fixing belt at a given temperature, and the pressing roller and the fixing belt are rotated in the same given direction at the tangent. During this period, the medium on which an image is formed enters the tangent between the pressing roller and the fixing belt. The pressing roller and the fixing belt nip the medium with an image entering the space therebetween and convey the medium in the given direction. The heated fixing belt heats the image on the medium while pressing against the medium to fix the image on the medium.

It is preferred that the temperature along the tangent is uniform so that the fixing belt used in the electromagnetic induction heating type fixing device can uniformly fix the entire image on the medium. Therefore, the thickness of the heat generation layer of the fixing belt needs to be made uniform in the whole fixing belt.

However, according to the current technology, it is difficult to make the thickness of the heat generation layer of the fixing belt uniform in the whole fixing belt.

Thus, at the present time, a heating test is carried out on each of a plurality of fixing belts which has just been manufactured through a tester accompanied with the electromagnetic induction heating device before incorporating the fixing belt in the fixing device. In the heating test, the fixing belt that generates heat at a temperature beyond a given allowable temperature range is discarded.

The heating test makes the manufacture process of the fixing belt much more complicated, and causes an increase in the manufacture cost of the fixing belt. The discarded fixing belt also causes an increase in the manufacture cost of the fixing belt.

BRIEF DESCRIPTION OF THE DRAWINGS

FIG. 10 is a diagram illustrating the relation between the temperature distribution in the width direction in each of the fixing belts of the first-fourth examples and the foregoing ideal standard fixing belt (ideal standard belt) assembled in the fixing device shown in FIG. 2 and the corresponding abnormality detection temperatures set in a plurality of temperature detection devices, as well as the afore-mentioned relation in each of two fixing belts (not shown) in which the temperature distribution in the width direction is contrary (in the one side and the other side) to that in the fixing belts of the first and the second examples;

DETAILED DESCRIPTION

Generally, in accordance with one embodiment, a fixing device comprises a fixing belt configured to generate heat through electromagnetic induction; a pressing roller configured to contact with the fixing belt; a rotation drive source configured to rotate at least one of the fixing belt and the pressing roller at a given direction; an electromagnetic induction heating device configured adjacent to the fixing belt; a plurality of temperature detection devices configured along a width direction of the fixing belt at intervals to measure the temperature of the fixing belt and send a temperature signal corresponding to the measured temperature; and a control device configured to consist of a storage section and a control section and connect with the plurality of temperature detection devices and the electromagnetic induction heating device; wherein the control section of the control device supplies a given output for the electromagnetic induction heating device to heat the fixing belt when the fixing belt is annularly rotated for the first time after the fixing belt is supported in the fixing device for the first time, and measures an initial distribution of heat generation temperature in the fixing belt on the basis of the temperature signal sent by the plurality of temperature detection devices corresponding to the heat generation temperature of the fixing belt. The control section further controls the output supplied for the electromagnetic induction heating device on the basis of the measured initial distribution of the heat generation temperature to control the distribution of the heat generation temperature in a given range. Then the storage section of the control device stores the control of the output. The control section controls the output supplied for the electromagnetic induction heating device based on the control stored in the storage section every time the fixing belt is rotated after an initial rotation.

In addition, the initial rotation of the fixing belt, which refers to the number of rotation required to control the distribution of the heat generation temperature in the given range by the control section, is not limited to once, and it may be carried out for a plurality of times.

Hereinafter, the image forming apparatus according to the embodiment and the fixing device used in the image forming apparatus according to the embodiment are described in detail with reference to the accompanying drawings.

Figure 1:
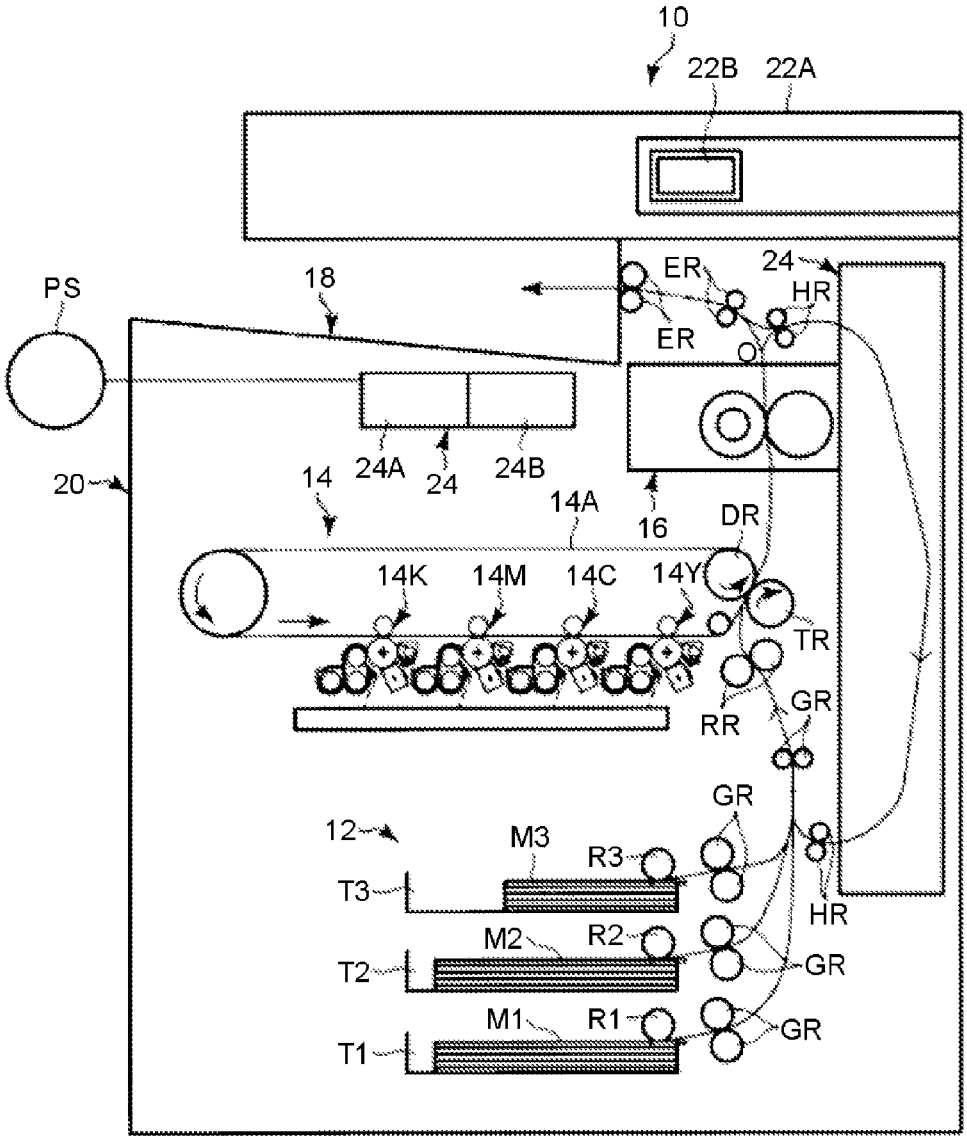
FIG. 1 is a diagram schematically illustrating a whole image forming apparatus provided with a fixing device according to one embodiment.

As show in FIG. 1, in accordance with one embodiment, an image forming apparatus 10 includes a medium supply section 12 for supplying a medium on which an image is to be formed and an image forming section 14 for forming a desired image on the medium supplied from the medium supply section 12. The image forming apparatus 10 further includes a fixing device 16 for fixing the desired image formed on the medium by the image forming section 14 on the medium and a medium discharge section 18 for stacking the discharged medium on which the desired image is fixed by the fixing device 16. The medium supply section 12, the image forming section 14 and the fixing device 16 are arranged in an order from the bottom to the top inside the housing 20. Part of the upper portion of the housing 20 serves as the medium discharge section 18.

In accordance with one embodiment, the image forming apparatus 10 includes an image information input device 22A and a manual operation information input device 22B at the upmost portion of the inner space of the housing 20. The image information input device 22A is, for example, a scanner. The manual operation information input device 22B is, for example, a touch screen for a user to manually input various kinds of operation information for the image forming apparatus 10. A control device 24 including a control section 24A and a storage section 24B is also arranged in the inner space of the housing 20.

The control section 24A may include, for example, a CPU (Central Processing Unit), and the storage section 24B may include, for example, a RAM (Random Access Memory).

The medium supply section 12, the image forming section 14, the fixing device 16, the image information input device 22A and the manual information input device 22B are electrically connected with the control section 24A of the control device 24. A power source PS is also electrically connected with the control device 24. The control section 24A of the control device 24 can also be connected with an external image information input device and an external manual operation information input device (neither is shown). One example of the combination of the external image information input device and the external manual operation information input device (neither is shown) is a personal computer. In the personal computer, for example, characters or other symbolic information serving as one kind of image information created using an image information input device such as a keyboard can be input to the control device 24, and the keyboard may function as the manual operation information input device. The image information mentioned herein refers to information relating to the shape, size, color and the like of signs, pictures and characters that can be input through the scanner or keyboard. Further, the operation information, which refers to information relating to all the operations carried out by the image forming apparatus 10, includes, for example, the number of images to be formed by the image forming apparatus 10 based on the input image information, the enlarging/reducing of the shape, the selection of the color, the selection of the medium in the medium supply section 12 to form an image on, the selection of single-side use or both-side use of the selected medium, the method of discharging the selected medium to the medium discharge section 18.

The medium supply section 12 includes at least one tray for storing a medium such as a sheet or a plastic sheet having a given size. The at least one tray is detachably arranged at a given position of the inner space of the housing 20. In the present embodiment, the medium supply section 12 includes a plurality of trays T1, T2 and T3 for respectively storing a plurality of types of media M1, M2 and M3 having different given sizes. The plurality of trays T1, T2 and T3 are detachably arranged at given positions of the inner space of the housing 20. The medium supply section 12 further includes pickup rollers R1, R2 and R3 which can pick up, one by one, the medium M1, M2 or M3 from each of the trays T1, T2 and T3. The medium supply section 12 further includes a medium supply guide (not shown) extending from each of the tray Ti, T2 and T3 towards the upper image forming section 14 and a plurality of conveyance roller pairs GR arranged along the medium supply guide (not shown). The combination of the medium supply guide (not shown) and the plurality of conveyance roller pairs GR conveys the medium M1, M2 or M3 picked up from each of the trays T1, T2 and T3 towards the upper image forming section 14. The medium supply section 12 is also provided with a register roller pair RR positioned at the end of the medium supply guide (not shown). The register roller pair RR adjusts the timing for conveying the medium M1, M2 or M3 reaching the end of the medium supply guide from the end to the image forming section 14.

The image forming section 14 according to the embodiment includes a transfer belt 14A rotating in a given direction at a given speed, and a black image forming device 14K, a magenta image forming device 14M, a cyan image forming device 14C and a yellow image forming device 14Y which are arranged along the transfer belt 14A in a given order. The black image forming device 14K, the magenta image forming device 14M, the cyan image forming device 14C and the yellow image forming device 14Y can serve as electrophotographic type image forming devices for forming an image of each color with the black toner, the magenta toner, the cyan toner and the yellow toner on the transfer belt 14A. Alternatively, the black image forming device 14K, the magenta image forming device 14M, the cyan image forming device 14C and the yellow image forming device 14Y can serve as thermal transfer type image forming devices for forming an image of each color on the transfer belt 14A using a black thermal transfer ink ribbon, a magenta thermal transfer ink ribbon, a cyan thermal transfer ink ribbon and a yellow thermal transfer ink ribbon.

A drive and guide roller DR of the transfer belt 14A of the image forming section 14 arranged nearby the end of the medium supply guide (not shown) of the medium supply section 12 is pressed against a transfer roller TR across the transfer belt 14A.

An image forming medium guide (not shown) is arranged to extend from the tangent between the part of the transfer belt 14A on the drive and guide roller DR of the image forming section 14 and the transfer roller TR towards the upper fixing device 16.

An image forming medium discharge guide (not shown) is arranged to extend from the upper outlet of the fixing device 16 towards the medium discharge section 18 at the upper portion of the housing 20. An image forming medium reversing section 24 is arranged in the inner space of the housing 20 at one side of the fixing device 16 and the image forming section 14. An image forming medium reversing guide (not shown) is further arranged to extend from the upper outlet of the fixing device 16 towards the image forming medium reversing section 24.

The lower end of the image forming medium reversing guide (not shown) is at the upstream side of the register roller pair RR positioned at the end of the medium supply guide (not shown) of the medium supply section 12.

At the upper outlet of the of the fixing device 16 is arranged a distribution gate member (not shown) for guiding the image forming medium discharged from the outlet to either of the image forming medium discharge guide (not shown) or the image forming medium reversing guide (not shown).

A plurality of image forming medium discharge roller pairs ER is arranged along the image forming medium discharge guide (not shown). A plurality of image forming medium reversing roller pairs HR is arranged along the image forming medium reversing guide (not shown).

The distribution gate member (not shown), the plurality of image forming medium discharge roller pairs ER and the plurality of image forming medium reversing roller pairs HR are also connected with the control section 24A of the control device 24, and the operations thereof are controlled based on an operation control signal from the control section 24A of the control device 24.

The operations of the image forming apparatus 10 with the constitution described above are schematically described below.

When image information is input through the image information input device 22A and operation information is input through the manual operation information input device 22B, or when image information is input through the external image information input device (not shown) and operation information is input through the operation information input device, the medium supply section 12 operates as follows. The medium supply section 12 picks up the selected medium M1, M2 or M3 from the corresponding tray T1, T2 or T3 by the pickup roller R1, R2 or R3 based on the operation control signal from the control section 24A of the control device 24. Then the medium supply section 12 conveys the selected medium M1, M2 or M3 to the register roller pair RR positioned at the end of the medium supply guide (not shown) through the plurality of conveyance roller pairs GR arranged along the medium supply guide (not shown).

According to the operation information, if it is a case of forming any one of the black image, the magenta image, the cyan image and the yellow image on the single side of the selected medium based on the image information, the image forming apparatus 10 operates as follows.

The image forming section 14 rotates the transfer belt 14A at a given speed in a given direction (anticlockwise direction in FIG. 1) and meanwhile forms an image of the selected one color on the transfer belt 14A through the black image forming device 14K, the magenta image forming device 14M, the cyan image forming device 14C or the yellow image forming device 14Y. The control section 24A of the control device 24 drives the register roller pair RR of the medium supply section 12 at the timing when the image of the selected one color on the transfer belt 14A reaches the position of the transfer roller TR. The register roller pair RR moves the selected medium M1, M2 or M3 towards the tangent between the transfer belt 14A and the transfer roller TR. At the tangent, the transfer belt 14A transfers the image of the selected one color thereon to the single side (transfer belt opposing surface) facing the transfer belt 14A of the selected medium M1, M2 or M3 on the transfer roller TR. In this way, the selected medium M1, M2 or M3 to which the image of one color is transferred is conveyed to the fixing device 16.

The control section 24A of the control device 24 heats the fixing device 16 at a given temperature. When the selected medium M1, M2 or M3 to which the image is transferred passes through the fixing device 16, the fixing device 16 presses the transferred image on the single side of the selected medium M1, M2 or M3 at a given pressure and a given temperature. As a result, the transferred image is fixed on the single side of the selected medium M1, M2 or M3.

If the actual temperature the fixing device 16 applied to the transferred image is much higher than the given temperature and the temperature difference between the applied temperature and the given temperature is beyond the allowable range, the transferred image separates from the selected medium M1, M2 or M3. On the other hand, if the actual temperature the fixing device 16 applied to the transferred image is much lower than the given temperature and the temperature difference between the applied temperature and the given temperature is beyond the allowable range, the transferred image is not sufficiently fixed on the selected medium M1, M2 or M3. If the temperature of the fixing device 16 is way too high and is beyond the allowable range of the given temperature, the control section 24A of the control device 24 stops heating the fixing device 16 so as to avoid the failure of the fixing device 16.

The distribution gate member (not shown) guides the selected medium M1, M2 or M3 which is discharged from the upper outlet of the fixing device 16 and on which the image is fixed to the image forming medium discharge guide (not shown). The plurality of image forming medium discharge roller pairs ER discharge the selected medium M1, M2 or M3 on which the image is fixed to the medium discharge section 18 from the image forming medium discharge guide (not shown).

According to the operation information, if it is a case of forming an image of a plurality colors selected from the black image, the magenta image, the cyan image and the yellow image on the single side of the selected medium based on the image information, the image forming apparatus 10 operates as follows.

The image forming section 14 rotates the transfer belt 14A at a given speed in a given direction (anticlockwise direction in FIG. 1) and meanwhile forms an image of a plurality of selected colors on the transfer belt 14A through the black image forming device 14K, the magenta image forming device 14M, the cyan image forming device 14C and the yellow image forming device 14Y. Then the transfer roller TR transfers the image of a plurality of selected colors on the transfer belt 14A to the single side of the selected medium M1, M2 or M3 from the register roller pair RR of the medium supply section 12. The fixing device 16 fixes the transferred image of a plurality of colors on the single side of the selected medium M1, M2 or M3. The distribution gate member (not shown) at the upper outlet of the fixing device 16 guides the selected medium M1, M2 or M3 on which the image of a plurality of colors is fixed to the image forming medium discharge guide (not shown). The plurality of image forming medium discharge roller pairs ER of the image forming medium discharge guide discharge the selected medium M1, M2 or M3 on which the image of a plurality of colors is fixed to the medium discharge section 18 from the image forming medium discharge guide (not shown).

According to the operation information, if it is a case of forming an image of at least one color selected from the black image, the magenta image, the cyan image and the yellow image on both sides of the selected medium based on the image information, the image forming apparatus 10 operates as follows.

The operations of the image forming apparatus 10 during a period of forming an image of at least one color selected from the black image, the magenta image, the cyan image and the yellow image on the single side of the selected medium based on the image information, and the operations carried out until the selected medium on the single side of which the image of at least one selected color is fixed is guided to the image forming medium discharge guide (not shown) from the upper outlet of the fixing device 16 through the distribution gate member (not shown) are the same as that described above.

The plurality of image forming medium discharge roller pairs ER of the image forming medium discharge guide (not shown) are rotated reversely before the selected medium M1, M2 or M3 on the single side of which the image of at least one selected color is fixed is completely discharged to the medium discharge section 18 from the image forming medium discharge guide. Simultaneously, the distribution gate member (not shown) guides the selected medium M1, M2 or M3 to the image forming medium reversing guide (not shown) from the image forming medium discharge guide.

The plurality of image forming medium reversing roller pairs HR convey the selected medium M1, M2 or M3 which is guided by the image forming medium reversing guide (not shown) and on the single side of which the image of at least one color is fixed to the register roller pair RR of the medium supply section 12.

During this period, the image forming section 14 rotates the transfer belt 14A at a given speed in a given direction (anticlockwise direction in FIG. 1) and meanwhile forms the image of at least one color, which will be formed on the other single side of the selected medium M1, M2 or M3, on the transfer belt 14A through the black image forming device 14K, the magenta image forming device 14M, the cyan image forming device 14C or the yellow image forming device 14Y.

Then the transfer roller TR transfers the image of at least one color on the transfer belt 14A to the other single side of the selected medium M1, M2 or M3 from the register roller pair RR of the medium supply section 12. The fixing device 16 fixes the transferred image of at least one color on the other single side of the selected medium M1, M2 or M3. The distribution gate member (not shown) at the upper outlet of the fixing device 16 guides the selected medium M1, M2 or M3 on the other single side of which the image of at least one color is fixed to the image forming medium discharge guide (not shown). The plurality of image forming medium discharge roller pairs ER of the image forming medium discharge guide discharge the selected medium M1, M2 or M3, on the other single side of which the image of at least one color is fixed, that is, on each side of which the image of at least one color is fixed, to the medium discharge section 18 from the image forming medium discharge guide (not shown).

Next, the fixing device 16 according to the embodiment is described in detail with reference to FIG. 2-FIG. 4.

The fixing device 16 includes an endless fixing belt 30 and a pressing roller 32. The fixing belt 30 having a longitudinal direction and a width direction orthogonal to the longitudinal direction is supported to be capable of rotating annularly in the longitudinal direction. The pressing roller 32, which includes a rotation center line CA extending in the width direction, contacts with the fixing belt 30 at the tangent extending in the width direction.

The pressing roller 32 includes a rotation center axis 32A rotatably supported on the housing 16A of the fixing device 16 and an annular elastic cylinder 32B concentrically arranged around the rotation center axis 32A to rotate along with the rotation center axis 32A.

Figure 3:
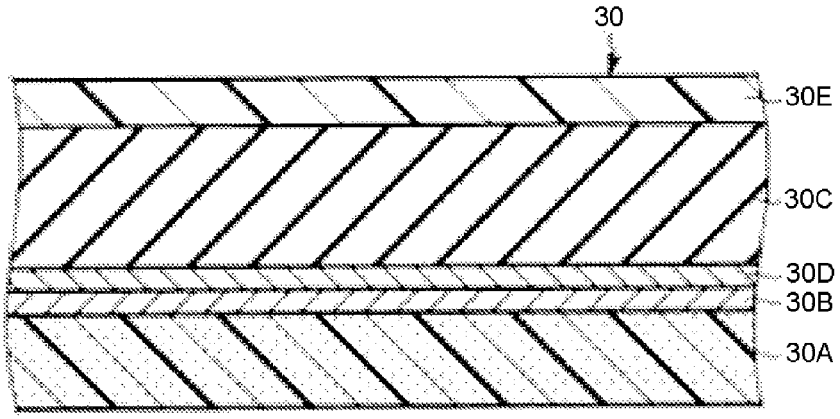
FIG. 3 is a schematic cross-sectional view of the fixing belt of the fixing device shown in FIG. 2 along a section line III-III.

As shown in FIG. 3, the fixing belt 30 includes an inner substrate layer 30A, a heat generation layer 30B which is laminated on the outer peripheral surface of the substrate layer 30A to generate heat through electromagnetic induction and an elastic layer 30C laminated on the outer peripheral surface of the heat generation layer 30B. In the present embodiment, the substrate layer 30A is made of elastic material reinforced with fibers (not shown), such as synthetic rubber. The heat generation layer 30B is formed by copper plating. The elastic layer 30C is made of elastic material such as synthetic rubber.

The fixing belt 30 according to the embodiment further includes a functional layer 30D between the elastic layer 30C and the heat generation layer 30B to assist the function of the heat generation layer 30B. In the present embodiment, the functional layer 30D is formed by nickel plating. The fixing belt 30 according to the embodiment further includes a peeling layer 30E covering the surface of the elastic layer 30C. The peeling layer 30E can prevent the medium pressed thereon and the image on the surface of the medium from adhering to the peeling layer 30E.

The fixing belt 30 is supported to be capable of rotating annularly in the longitudinal direction by a supporting member (not shown) in the housing 16A of the fixing device 16.

The fixing device 16 further includes a rotation drive source for rotating at least one of the fixing belt 30 and the pressing roller 32 in a given direction. In the present embodiment, the rotation drive source is a pulse motor PM connected with the rotation center axis 32A of the pressing roller 32.

The fixing device 16 further includes an electromagnetic induction heating device 34 arranged adjacent to a portion positioned at a side opposite to the pressing roller 32 at the outer peripheral surface of the fixing belt 30.

The fixing device 16 is further provided with a pressure pad 36 arranged adjacent to the pressing roller 32 in the space surrounded by the inner peripheral surface of the fixing belt 30. The pressure pad 36 is constituted to press the portion of the outer peripheral surface of the fixing belt 30 adjacent to the pressing roller 32 against the outer peripheral surface of the pressing roller 32 at a given pressure.

The fixing device 16 is further provided with an electromagnetic wave shielding member 38 arranged in the space surrounded by the inner peripheral surface of the fixing belt 30 at a position opposite to the electromagnetic induction heating device 34 across the fixing belt 30. In the present embodiment, the electromagnetic wave shielding member 38 is made of aluminum.

The fixing device 16 is further provided with a magnetic shunt member 40 arranged in the space surrounded by the inner peripheral surface of the fixing belt 30 at a position between the electromagnetic induction heating device 34 and the electromagnetic wave shielding member 38. The magnetic shunt member 40 is made from a material that will turn into a nonmagnetic material through which the magnetic flux cannot flow if the temperature is higher than the Curie temperature.

Figure 2:
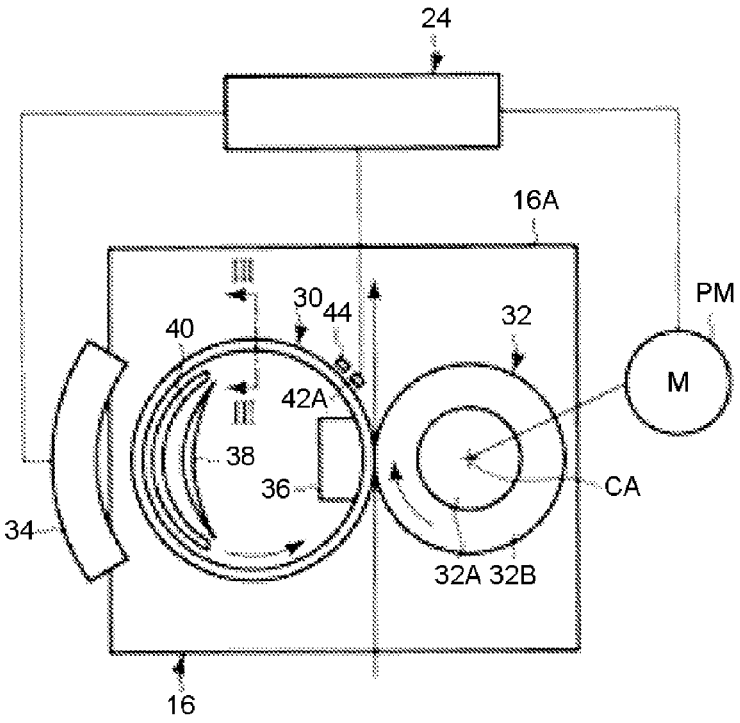
FIG. 2 is a schematic enlarged diagram of the fixing device shown in FIG. 1 according to the embodiment.
Figure 4:
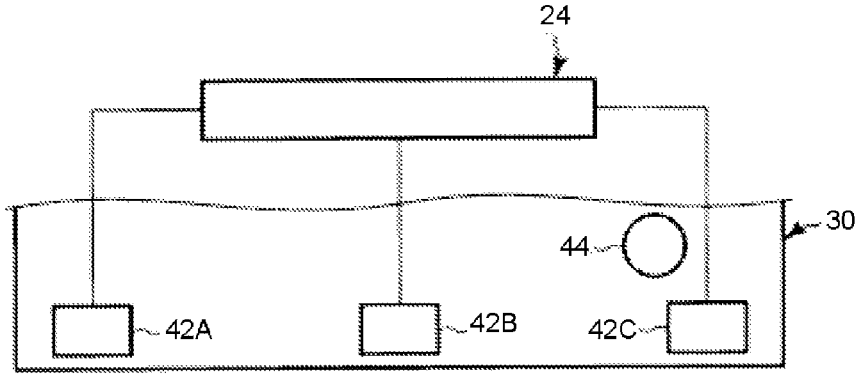
FIG. 4 is a diagram schematically illustrating the arrangements of a plurality of temperature detection devices in the fixing device shown in FIG. 2.

As shown in FIG. 2 and FIG. 4, the fixing device 16 is further provided with a plurality of temperature detection devices 42A, 42B and 42C arranged just at the downstream side of the tangent between the fixing belt 30 and the pressing roller 32 along the width direction of the fixing belt 30 at intervals. The plurality of temperature detection devices 42A, 42B and 42C respectively measure the temperatures of a plurality of corresponding portions of the outer peripheral surface of the fixing belt 30 and send temperature signals corresponding to the measured temperatures. Each of the plurality of temperature detection devices 42A, 42B and 42C may be, for example, a thermistor, a thermopile or other temperature detection device which sends the temperature signals corresponding to the measured temperatures.

The fixing device 16 is further provided with a thermostat 44 arranged at a given position nearby the plurality of temperature detection devices 42A, 42B and 42C. The thermostat 44, which is arranged between the electromagnetic induction heating device 34 and a power source circuit (not shown) for the electromagnetic induction heating device 34, cuts off the power supplied for the electromagnetic induction heating device 34 if the temperature of the given position of the fixing belt 30 is higher than a given value, so as to prevent the fixing belt 30 from being damaged due to heat.

In the fixing device 16, the pulse motor PM, the plurality of temperature detection devices 42 and the electromagnetic induction heating device 34 are connected with the control section 24A of the control device 24. The control section 24A of the control device 24 controls the output supplied for the electromagnetic induction heating device 34 based on the temperature signals from the plurality of temperature detection devices 42A, 42B and 42C.

In the process of assembling the fixing device 16 of the image forming apparatus 10 with the constitution described above according to the embodiment, the fixing belt 30 is arranged at a given position in the fixing device 16 in the final stage of the assembling process.

Further, if the fixing belt 30 cannot generate desired heat in the use of the fixing device 16, the fixing belt 30 is replaced with a new fixing belt 30.

In the fixing belt 30, the material and the thickness of the heat generation layer 30B and the functional layer 30D are designed so that the temperatures of a plurality of portions of the outer peripheral surface along the tangent between the fixing belt 30 and the pressing roller 32 are in a given allowable range of a given fixing temperature when given power is supplied for the electromagnetic induction heating device 34 and the electromagnetic induction heating device 34 exerts a given output in the fixing device 16.

In the present embodiment, a belt defect detection circuit (not shown) including a belt defect detection lamp (not shown) is assembled in the fixing device 16. If the power source switch (not shown) of the image forming apparatus 10 is turned on after a new fixing belt 30 is assembled at the given position of the fixing device 16, the belt defect detection lamp (not shown) lights up temporarily and then goes out. In a case where a defective fixing belt 30 that cannot generate desired heat even if being used is assembled at the given position of the fixing device 16, or in a case where the fixing belt 30 cannot generate desired heat any more in the use of the fixing device 16, the belt defect detection lamp (not shown) continuously lights up when the power source switch (not shown) of the image forming apparatus 10 is ON.

In the present embodiment, after one fixing belt 30 is assembled at the given position of the fixing device 16 for the first time, the control section 24A of the control device 24 supplies, for the first time, a given power (for example, 600W) for the electromagnetic induction heating device 34 from the power source PS for a given time (for example, 3 minutes) and annularly rotates the fixing belt 30 at a given speed in a given direction for the first time, before the image forming apparatus 10 is used to carry out the image forming processing.

Figure 5:
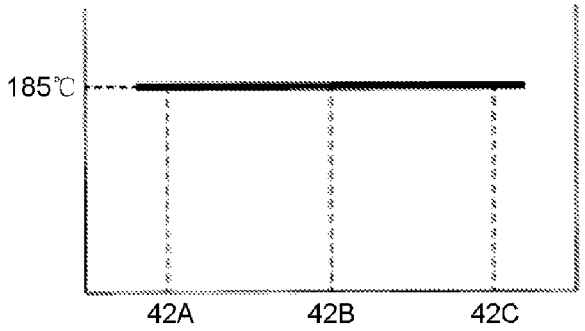
FIG. 5 is a diagram schematically illustrating an average temperature distribution in a width direction of an ideal fixing belt (ideal standard belt) when the ideal fixing belt (ideal standard belt) created exactly as designed is assembled in the fixing device shown in FIG. 2 and is heated by an electromagnetic induction heating device at a given condition for the first time.

As shown in FIG. 5, the fixing belt 30 according to the embodiment is designed so that the temperatures of the plurality of portions of the outer peripheral surface reach a desired fixing temperature of 185 degrees centigrade during this period. The fixing belt 30 that can function exactly as the design is an ideal standard belt.

However, according to the current manufacture process of the fixing belt 30, it is impossible to form each of the heat generation layer 30B and the functional layer 30C at a desired uniform thickness as stated above. However, the fixing belt 30 manufactured through the current manufacture process of the fixing belt 30 can generate heat in a heat generation temperature range smaller than the allowable range of the desired fixing temperature when the given power is applied to the electromagnetic induction heating device 34 to generate heat.

Figure 6:
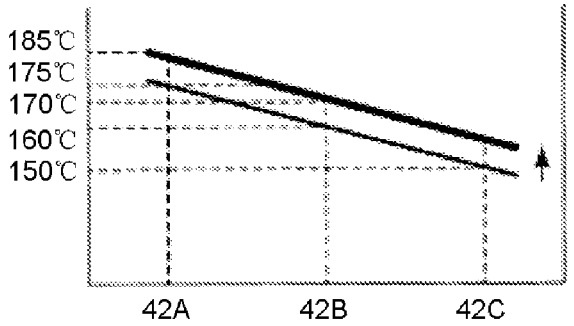
FIG. 6 is a diagram schematically illustrating an average initial temperature distribution in the width direction of a fixing belt of a first example when the fixing belt of the first example is assembled in the fixing device shown in FIG. 2 and is heated by the electromagnetic induction heating device at the given condition for the first time, and an average temperature distribution in the width direction of the fixing belt of the first example after the heating condition is changed.

For example, when the control section 24A of the control device 24 supplies, for the first time, the given power for the electromagnetic induction heating device 34 for the given time after the fixing belt 30 of a first example is assembled at the given position in the fixing device 16 for the first time, the control section 24A of the control device 24 detects the heat generation temperature of the fixing belt 30 of the first example which is annularly rotated at the given speed in the given direction for the first time through the plurality of temperature detection devices 42A, 42B and 42C, and one example of the detection results is schematically shown in FIG. 6.

The control section 24A of the control device 24 measures the initial distribution of the heat generation temperature in the longitudinal direction and the width direction of the fixing belt 30 of the first example on the basis of the temperature signal corresponding to the heat generation temperature sent by the plurality of temperature detection devices 42A, 42B and 42C during this period. It can be known from FIG. 6 that the change of temperature in the longitudinal direction is small while the change of temperature in the width direction is large. FIG. 6 shows, with a thin line, the average trend of the initial temperature distribution in the width direction at each of the plurality of positions along the longitudinal direction in this case.

In this case, the temperature measured by the temperature detection device 42A at one side is about 175 degrees centigrade which is a little lower than the desired fixing temperature (185 degrees centigrade) shown in FIG. 5. At the same time, the temperature measured by the central temperature detection device 42B is about 160 degrees centigrade which is lower than the desired fixing temperature (185 degrees centigrade) shown in FIG. 5. Further, the temperature measured by the temperature detection device 42C at the other side at the same time is about 150 degrees centigrade which is lower than the temperature measured by the central temperature detection device 42B. The initial temperature distribution in the width direction of the fixing belt 30 of the first example is in a range within the allowable range (about 150-200 degrees centigrade) of the desired fixing temperature.

However, the maximum value of the initial temperature distribution in the width direction of the fixing belt 30 of the first example is about 175 degrees centigrade which is about 25 degrees centigrade lower than the upper limit value (about 200 degrees centigrade) of the allowable range, while the minimum value of the initial temperature distribution in the width direction of the fixing belt 30 of the first example is about 150 degrees centigrade which is almost the same with the lower limit value (about 150 degrees centigrade) of the allowable range. Thus, the average of the initial temperature distribution in the width direction of the fixing belt 30 of the first example can be raised for about 25 degrees centigrade at most, in this way, the average fixing temperature (about 160 degrees centigrade) of the temperature distribution in the width direction of the fixing belt 30 of the first example can get close to the designed fixing temperature (185 degrees centigrade).

In this case, the control section 24A of the control device 24 carries out a control so that the output supplied from the power source PS for the electromagnetic induction heating device 34 is larger than the initial output when the image forming apparatus 10 including the fixing device 16 using the fixing belt 30 of the first example forms the image selected as stated above on the medium M1, M2 or M3 selected as stated above.

For example, the foregoing control is carried out so that the entire temperature distribution in the width direction of the fixing belt 30 of the first example is raised, for example, about 10 degrees centigrade on average, as shown by the bold line in FIG. 6. As a result, the temperature measured by the temperature detection device 42A at one side is about 185 degrees centigrade which is the same as the desired fixing temperature (185 degrees centigrade) shown in FIG. 5. At the same time, the temperature measured by the central temperature detection device 42B is about 170 degrees centigrade which is lower than the desired fixing temperature (185 degrees centigrade) shown in FIG. 5. Further, the temperature measured by the temperature detection device 42C at the other side at the same time is about 160 degrees centigrade which is lower than the temperature measured by the central temperature detection device 42B. The temperature distribution in the width direction of the fixing belt 30 of the first example is in a range within the allowable range (about 150-200 degrees centigrade) of the desired fixing temperature, and the average fixing temperature is about 170 degrees centigrade, which is closer to the designed fixing temperature (185 degrees centigrade).

In addition, the control described above is just one example, and a control may be carried out to further increase the output supplied from the power source PS for the electromagnetic induction heating device 34 in a range so that the entire temperature distribution in the width direction of the fixing belt 30 of the first example is raised for about 25 degrees centigrade on average. In a case of raising the entire temperature distribution in the width direction of the fixing belt 30 of the first example for about 25 degrees centigrade on average, the temperature measured by the temperature detection device 42A at one side is about 200 degrees centigrade which is higher than the desired fixing temperature (185 degrees centigrade) shown in FIG. 5. At the same time, the temperature measured by the central temperature detection device 42B is the same as the desired fixing temperature (185 degrees centigrade) shown in FIG. 5. Further, the temperature measured by the temperature detection device 42C at the other side at the same time is about 175 degrees centigrade which is lower than the temperature measured by the central temperature detection device 42B. As a result, the temperature distribution in the width direction of the fixing belt 30 of the first example is in a range within the allowable range (about 150-200 degrees centigrade) of the desired fixing temperature, and the average fixing temperature is about 185 degrees centigrade, which is closer to the designed fixing temperature (185 degrees centigrade).

The storage section 24B of the control device 24 stores such a control of the electromagnetic induction heating device 34. When the image forming apparatus 10 including the fixing device 16 using the fixing belt 30 of the first example forms the image selected as stated above on the medium M1, M2 or M3 selected as stated above after the foregoing initial rotation of the fixing belt 30 of the first example, the control section 24A of the control device 24 generally supplies the output from the power source PS for the electromagnetic induction heating device 34 according to the control.

Figure 7:
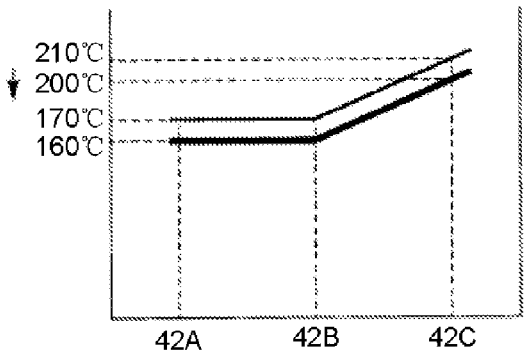
FIG. 7 is a diagram schematically illustrating an average initial temperature distribution in the width direction of a fixing belt of a second example when the fixing belt of the second example is assembled in the fixing device shown in FIG. 2 and is heated by the electromagnetic induction heating device at the given condition for the first time, and an average temperature distribution in the width direction of the fixing belt of the second example after the heating condition is changed.

When the control section 24A of the control device 24 supplies, for the first time, the given power for the electromagnetic induction heating device 34 for the given time after the fixing belt 30 of a second example is assembled in the fixing device 16 for the first time, the control section 24A of the control device 24 detects the heat generation temperature of the fixing belt 30 of the second example which is annularly rotated at the given speed in the given direction for the first time through the plurality of temperature detection devices 42A, 42B and 42C, and one example of the detection results is schematically shown in FIG. 7.

The control section 24A of the control device 24 measures the initial distribution of the heat generation temperature in the longitudinal direction and the width direction of the fixing belt 30 of the second example on the basis of the temperature signal corresponding to the heat generation temperature sent by the plurality of temperature detection devices 42A, 42B and 42C during this period. It can be known from FIG. 7 that the change of temperature in the longitudinal direction is small while the change of temperature in the width direction is large. FIG. 7 shows, with a thin line, the average trend of the initial temperature distribution in the width direction at each of the plurality of positions along the longitudinal direction in this case.

In this case, the temperature measured by the temperature detection device 42A at one side is about 170 degrees centigrade which is a little lower than the desired fixing temperature (185 degrees centigrade) shown in FIG. 5. At the same time, the temperature measured by the central temperature detection device 42B is about 170 degrees centigrade which is a little lower than the desired fixing temperature (185 degrees centigrade) shown in FIG. 5. Further, the temperature measured by the temperature detection device 42C at the other side at the same time is about 210 degrees centigrade which is much higher than the temperature measured by the central temperature detection device 42B. The initial temperature distribution in the width direction of the fixing belt 30 of the second example is not in a range within the allowable range (about 150-200 degrees centigrade) of the desired fixing temperature.

The maximum value of the initial temperature distribution in the width direction of the fixing belt 30 of the second example is about 210 degrees centigrade which is about 10 degrees centigrade higher than the upper limit value (about 200 degrees centigrade) of the allowable range, while the minimum value of the initial temperature distribution in the width direction of the fixing belt 30 of the second example is about 170 degrees centigrade which is about 20 degrees centigrade higher than the lower limit value (about 150 degrees centigrade) of the allowable range. Thus, the average of the initial temperature distribution in the width direction of the fixing belt 30 of the second example can be lowered for about 20 degrees centigrade at most, in this way, the temperature distribution in the width direction of the fixing belt 30 of the second example can be controlled in a range within the allowable range (about 150-200 degrees centigrade) of the desired fixing temperature.

In this case, the control section 24A of the control device 24 carries out a control so that the output supplied from the power source PS for the electromagnetic induction heating device 34 is smaller than the initial output when the image forming apparatus 10 including the fixing device 16 using the fixing belt 30 of the second example forms the image selected as stated above on the medium M1, M2 or M3 selected as stated above.

Through such a control, the entire temperature distribution in the width direction of the fixing belt 30 of the second example is lowered, for example, about 10 degrees centigrade on average, as shown by the bold line in FIG. 7. As a result, the temperature measured by the temperature detection device 42A at one side is about 160 degrees centigrade which is lower than the desired fixing temperature (185 degrees centigrade) shown in FIG. 5.

At the same time, the temperature measured by the central temperature detection device 42B is about 160 degrees centigrade which is lower than the desired fixing temperature (185 degrees centigrade) shown in FIG. 5. Further, the temperature measured by the temperature detection device 42C at the other side at the same time is about 200 degrees centigrade which is higher than the temperature measured by the central temperature detection device 42B. However, as a result, the temperature distribution in the width direction of the fixing belt 30 of the second example is controlled in a range within the allowable range (about 150-200 degrees centigrade) of the desired fixing temperature, and the average fixing temperature is about 160 degrees centigrade.

The control described above is just one example, and a control may be carried out to further decrease the output supplied from the power source PS for the electromagnetic induction heating device 34 so that the entire temperature distribution in the width direction of the fixing belt 30 of the second example is lowered for about 20 degrees centigrade on average. In this case, the temperature measured by the temperature detection device 42A at one side is about 150 degrees centigrade which is lower than the desired fixing temperature (185 degrees centigrade) shown in FIG. 5. At the same time, the temperature measured by the central temperature detection device 42B is about 150 degrees centigrade which is lower than the desired fixing temperature (185 degrees centigrade) shown in FIG. 5. Further, the temperature measured by the temperature detection device 42C at the other side at the same time is about 190 degrees centigrade which is higher than the temperature measured by the central temperature detection device 42B. As a result, the temperature distribution in the width direction of the fixing belt 30 of the second example is in a range within the allowable range (about 150-200 degrees centigrade) of the desired fixing temperature, and the average fixing temperature is about 150 degrees centigrade.

The storage section 24B of the control device 24 stores such a control of the electromagnetic induction heating device 34. When the image forming apparatus 10 including the fixing device 16 using the fixing belt 30 of the second example forms the image selected as stated above on the medium M1, M2 or M3 selected as stated above after the foregoing initial rotation of the fixing belt 30 of the second example, the control section 24A of the control device 24 generally supplies the output from the power source PS for the electromagnetic induction heating device 34 according to the control.

Figure 8:
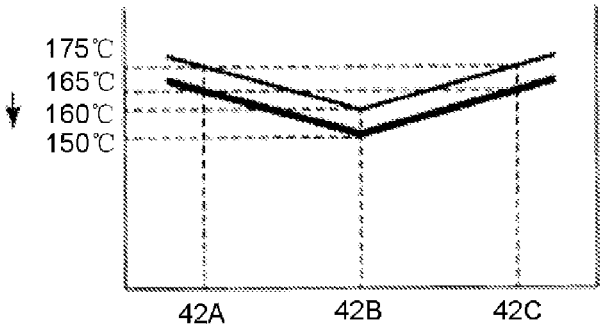
FIG. 8 is a diagram schematically illustrating an average initial temperature distribution in the width direction of a fixing belt of a third example when the fixing belt of the third example is assembled in the fixing device shown in FIG. 2 and is heated by the electromagnetic induction heating device at the given condition for the first time, and an average temperature distribution in the width direction of the fixing belt of the third example after the heating condition is changed.

When the control section 24A of the control device 24 supplies, for the first time, the given power for the electromagnetic induction heating device 34 for the given time after the fixing belt 30 of a third example is assembled in the fixing device 16 for the first time, the control section 24A of the control device 24 detects the heat generation temperature of the fixing belt 30 of the third example which is annularly rotated at the given speed in the given direction for the first time through the plurality of temperature detection devices 42A, 42B and 42C, and one example of the detection results is schematically shown in FIG. 8.

The control section 24A of the control device 24 measures the initial distribution of the heat generation temperature in the longitudinal direction and the width direction of the fixing belt 30 of the third example on the basis of the temperature signal corresponding to the heat generation temperature sent by the plurality of temperature detection devices 42A, 42B and 42C during this period. It can be known from FIG. 8 that the change of temperature in the longitudinal direction is small while the change of temperature in the width direction is large. FIG. 8 shows, with a thin line, the average trend of the initial temperature distribution in the width direction at each of the plurality of positions along the longitudinal direction in this case.

In this case, the temperature measured by the temperature detection device 42A at one side is about 175 degrees centigrade which is lower than the desired fixing temperature (185 degrees centigrade) shown in FIG. 5. At the same time, the temperature measured by the central temperature detection device 42B is about 160 degrees centigrade which is lower than the desired fixing temperature (185 degrees centigrade) shown in FIG. 5 and further lower than the temperature measured by the temperature detection device 42A at one side.

Further, the temperature measured by the temperature detection device 42C at the other side at the same time is about 175 degrees centigrade which is almost the same as the temperature measured by the temperature detection device 42A at one side. The initial temperature distribution in the width direction of the fixing belt 30 of the third example is in a range within the allowable range (about 150-200 degrees centigrade) of the desired fixing temperature.

However, the maximum value of the initial temperature distribution in the width direction of the fixing belt 30 of the third example is about 175 degrees centigrade which is about 25 degrees centigrade lower than the upper limit value (about 200 degrees centigrade) of the allowable range, and the minimum value of the initial temperature distribution in the width direction of the fixing belt 30 of the third example is about 160 degrees centigrade which is about 10 degrees centigrade higher than the lower limit value (about 150 degrees centigrade) of the allowable range. Then, the average of the initial temperature distribution in the width direction of the fixing belt 30 of the third example is lowered for about 10 degrees centigrade.

In this case, the control section 24A of the control device 24 carries out a control so that the output supplied from the power source PS for the electromagnetic induction heating device 34 is smaller than the initial output when the image forming apparatus 10 including the fixing device 16 using the fixing belt 30 of the third example forms the image selected as stated above on the medium M1, M2 or M3 selected as stated above.

For example, the foregoing control is carried out so that the entire temperature distribution in the width direction of the fixing belt 30 of the third example is lowered, for example, about 10 degrees centigrade on average, as shown by the bold line in FIG. 8. As a result, the temperature measured by each of the temperature detection devices 42A and 42C at two sides is about 165 degrees centigrade. At the same time, the temperature measured by the central temperature detection device 42B is about 150 degrees centigrade. The temperature distribution in the width direction of the fixing belt 30 of the third example is in a range within the allowable range (about 150-200 degrees centigrade) of the desired fixing temperature, and the average fixing temperature is about 160 degrees centigrade.

In addition, the control described above is just one example, and a control may be carried out to increase the output supplied from the power source PS for the electromagnetic induction heating device 34 so that the entire temperature distribution in the width direction of the fixing belt 30 of the third example is raised for about 25 degrees centigrade on average. In a case of raising the entire temperature distribution in the width direction of the fixing belt 30 of the third example for about 25 degrees centigrade on average, the temperature measured by each of the temperature detection devices 42A and 42C at two sides is about 200 degrees centigrade which is higher than the desired fixing temperature (185 degrees centigrade) shown in FIG. 5. At the same time, the temperature measured by the central temperature detection device 42B is the same as the desired fixing temperature (185 degrees centigrade) shown in FIG. 5. As a result, the temperature distribution in the width direction of the fixing belt 30 of the third example is in a range within the allowable range (about 150-200 degrees centigrade) of the desired fixing temperature, and the average fixing temperature is about 190 degrees centigrade, which is closer to the designed fixing temperature (185 degrees centigrade).

The storage section 24B of the control device 24 stores such a control of the electromagnetic induction heating device 34. When the image forming apparatus 10 including the fixing device 16 using the fixing belt 30 of the third example forms the image selected as stated above on the medium M1, M2 or M3 selected as stated above after the foregoing initial rotation of the fixing belt 30 of the third example, the control section 24A of the control device 24 generally supplies the output from the power source PS for the electromagnetic induction heating device 34 according to the control.

Figure 9:
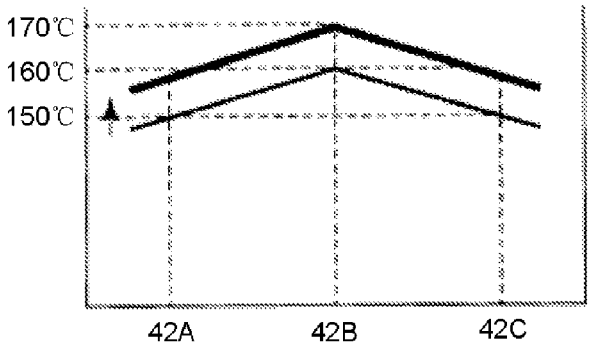
FIG. 9 is a diagram schematically illustrating an average initial temperature distribution in the width direction of a fixing belt of a fourth example when the fixing belt of the fourth example is assembled in the fixing device shown in FIG. 2 and is heated by the electromagnetic induction heating device at the given condition for the first time, and an average temperature distribution in the width direction of the fixing belt of the fourth example after the heating condition is changed.

When the control section 24A of the control device 24 supplies, for the first time, the given power for the electromagnetic induction heating device 34 for the given time after the fixing belt 30 of a fourth example is assembled at the given position in the fixing device 16 for the first time, the control section 24A of the control device 24 detects the heat generation temperature of the fixing belt 30 of the fourth example which is annularly rotated at the given speed in the given direction for the first time through the plurality of temperature detection devices 42A, 42B and 42C, and one example of the detection results is schematically shown in FIG. 9.

The control section 24A of the control device 24 measures the initial distribution of the heat generation temperature in the longitudinal direction and the width direction of the fixing belt 30 of the fourth example on the basis of the temperature signal corresponding to the heat generation temperature sent by the plurality of temperature detection devices 42A, 42B and 42C during this period. It can be known from FIG. 9 that the change of temperature in the longitudinal direction is small while the change of temperature in the width direction is large. FIG. 9 shows, with a thin line, the average trend of the initial temperature distribution in the width direction at each of the plurality of positions along the longitudinal direction in this case.

In this case, the temperature measured by the temperature detection device 42A at one side is about 150 degrees centigrade which is lower than the desired fixing temperature (185 degrees centigrade) shown in FIG. 5. At the same time, the temperature measured by the central temperature detection device 42B is about 160 degrees centigrade which is lower than the desired fixing temperature (185 degrees centigrade) shown in FIG. 5 and further higher than the temperature measured by the temperature detection device 42A at one side. Further, the temperature measured by the temperature detection device 42C at the other side at the same time is about 150 degrees centigrade which is almost the same as the temperature measured by the temperature detection device 42A at one side. The initial temperature distribution in the width direction of the fixing belt 30 of the fourth example is in a range within the allowable range (about 150-200 degrees centigrade) of the desired fixing temperature.

However, the maximum value of the initial temperature distribution in the width direction of the fixing belt 30 of the fourth example is about 160 degrees centigrade which is about 40 degrees centigrade lower than the upper limit value (about 200 degrees centigrade) of the allowable range, and the minimum value of the initial temperature distribution in the width direction of the fixing belt 30 of the fourth example is about 150 degrees centigrade which is the same as the lower limit value (about 150 degrees centigrade) of the allowable range. Thus, the average of the temperature distribution in the width direction of the fixing belt 30 of the fourth example can be raised for about 40 degrees centigrade at most, in this way, the minimum value (about 150 degrees centigrade) of the initial temperature distribution in the width direction of the fixing belt 30 of the fourth example can get close to the designed fixing temperature (185 degrees centigrade).

In this case, the control section 24A of the control device 24 carries out a control so that the output supplied from the power source PS for the electromagnetic induction heating device 34 is larger than the initial output when the image forming apparatus 10 including the fixing device 16 using the fixing belt 30 of the fourth example forms the image selected as stated above on the medium M1, M2 or M3 selected as stated above.

For example, the foregoing control is carried out so that the entire temperature distribution in the width direction of the fixing belt 30 of the fourth example is raised, for example, about 10 degrees centigrade on average, as shown by the bold line in FIG. 9. As a result, the temperature measured by each of the temperature detection devices 42A and 42C at two sides is about 160 degrees centigrade which is closer to the desired fixing temperature (185 degrees centigrade) shown in FIG. 5. At the same time, the temperature measured by the central temperature detection device 42B is about 170 degrees centigrade which is closer to the desired fixing temperature (185 degrees centigrade) shown in FIG. 5. The temperature distribution in the width direction of the fixing belt 30 of the fourth example is in a range within the allowable range (about 150-200 degrees centigrade) of the desired fixing temperature, and the average fixing temperature is about 165 degrees centigrade, which is closer to the designed fixing temperature (185 degrees centigrade).

In addition, the control described above is just one example, and a control may be carried out to increase the output supplied from the power source PS for the electromagnetic induction heating device 34 so that the entire temperature distribution in the width direction of the fixing belt 30 of the fourth example is raised for about 40 degrees centigrade on average. In a case of raising the entire temperature distribution in the width direction of the fixing belt 30 of the fourth example for about 40 degrees centigrade on average, the temperature measured by each of the temperature detection devices 42A and 42C at two sides is about 190 degrees centigrade which is higher than the desired fixing temperature (185 degrees centigrade) shown in FIG. 5. At the same time, the temperature measured by the central temperature detection device 42B is about 200 degrees centigrade which is much higher than the desired fixing temperature (185 degrees centigrade) shown in FIG. 5. As a result, the temperature distribution in the width direction of the fixing belt 30 of the fourth example is in a range within the allowable range (about 150-200 degrees centigrade) of the desired fixing temperature, and the average fixing temperature is about 195 degrees centigrade, which is closer to the designed fixing temperature (185 degrees centigrade).

The storage section 24B of the control device 24 stores such a control of the electromagnetic induction heating device 34. When the image forming apparatus 10 including the fixing device 16 using the fixing belt 30 of the fourth example forms the image selected as stated above on the medium M1, M2 or M3 selected as stated above after the foregoing initial rotation of the fixing belt 30 of the fourth example, the control section 24A of the control device 24 generally supplies the output from the power source PS for the electromagnetic induction heating device 34 according to the control.

As stated above, it can be known that in the image forming apparatus 10 according to the embodiment, various differences occur in the temperature distribution in the width direction according to the used fixing belt 30 even if the electromagnetic induction heating device 34 heats the fixing belt 30 through the given output for the given time. Even after the control section 24A of the control device 24 controls the operation of the electromagnetic induction heating device 34 to control the temperature distribution in the width direction of the fixing belt 30 in a given range, the temperature of side parts higher than the average fixing temperature at the approximate central part in the width direction is likely to be beyond the given range.

The control section 24A of the control device 24 can arbitrarily set an abnormality detection temperature in the plurality of temperature detection devices 42A, 42B and 42C to avoid the failure of the fixing device 16 caused by high temperature. Thus, the control section 24A of the control device can set the abnormality detection temperature of the temperature detection device 42A, 42B or 42C at side parts the temperature of which is higher than the average fixing temperature at the approximate central part in the width direction of the fixing belt 30 to a temperature lower than the abnormality detection temperature of the rest temperature detection device 42A, 423 or 42C.

In the embodiment described above, in the fixing belt 30 (ideal standard belt) shown in FIG. 5, in a case where the electromagnetic induction heating device 34 heats, for the first time, the fixing belt 30 through the given output for the given time after the ideal standard belt 30 is assembled in the fixing device 16 for the first time, the initial temperature distribution in the width direction is constant at about 185 degrees centigrade. Then the control section 24A of the control device 24 sets the abnormality detection temperature of each of the temperature detection devices 42A and the 42C at two sides the temperature of which is substantially equal to the average fixing temperature at the approximate central part in the width direction of the fixing belt 30 to 210 degrees centigrade.

In the fixing belt 30 of the first example shown in FIG. 6, in a case where the electromagnetic induction heating device 34 heats, for the first time, the fixing belt 30 through the given output for the given time after the fixing belt 30 of the first example is assembled in the fixing device 16 for the first time, the initial temperature distribution in the width direction is as follows: the temperature of the central part is about 160 degrees centigrade, and the temperature of one side is about 175 degrees centigrade which is higher than the temperature of the central part and the temperature of the other side is about 150 degrees centigrade which is lower than the temperature of the central part. Then the control of the operation of the electromagnetic induction heating device 34 for the fixing belt 30 of the first example based on the control section 24A of the control device 24 is set to raise the temperature distribution in the width direction of the fixing belt 30 of the first example for about 10 degrees centigrade. As a result, the control section 24A of the control device 24 lowers the abnormality detection temperature of the temperature detection device 42A at one side to 200 degrees centigrade while maintaining the abnormality detection temperature of the temperature detection device 42C at the other side at 210 degrees centigrade.

In the fixing belt 30 of the second example shown in FIG. 7, in a case where the electromagnetic induction heating device 34 heats, for the first time, the fixing belt 30 of the second example through the given output for the given time after the fixing belt 30 of the second example is assembled in the fixing device 16 for the first time, the initial temperature distribution in the width direction is as follows: the temperature of the central part is about 170 degrees centigrade and the temperature of one side is also about 170 degrees centigrade which is the same as the temperature of the central part, while the temperature of the other side is about 210 degrees centigrade which is higher than the temperature of the central part and is beyond the allowable range. Then the control of the operation of the electromagnetic induction heating device 34 for the fixing belt 30 of the second example based on the control section 24A of the control device 24 is set to lower the temperature distribution in the width direction of the fixing belt 30 of the second example for about 10 degrees centigrade. As a result, the control section 24A of the control device 24 maintains the abnormality detection temperature of the temperature detection device 42A at one side at 210 degrees centigrade while lowering the abnormality detection temperature of the temperature detection device 420 at the other side to 200 degrees centigrade.

In the fixing belt 30 of the third example shown in FIG. 8, in a case where the electromagnetic induction heating device 34 heats, for the first time, the fixing belt 30 through the given output for the given time after the fixing belt 30 of the third example is assembled in the fixing device 16 for the first time, the initial temperature distribution in the width direction is as follows: the temperature of the central part is about 160 degrees centigrade and the temperature of each of the two sides is about 175 degrees centigrade which is higher than the temperature of the central part. Then the control of the operation of the electromagnetic induction heating device 34 for the fixing belt 30 of the third example based on the control section 24A of the control device 24 is set to lower the temperature distribution in the width direction of the fixing belt 30 of the third example for about 10 degrees centigrade. As a result, the control section 24A of the control device 24 lowers the abnormality detection temperature of each of the temperature detection devices 42A and 42C at two sides to 200 degrees centigrade.

In the fixing belt 30 of the fourth example shown in FIG. 9, in a case where the electromagnetic induction heating device 34 heats, for the first time, the fixing belt 30 through the given output for the given time after the fixing belt 30 of the fourth example is assembled in the fixing device 16 for the first time, the initial temperature distribution in the width direction is as follows: the temperature of the central part is about 160 degrees centigrade and the temperature of each of the two sides is about 150 degrees centigrade which is lower than the temperature of the central part. Then the control of the operation of the electromagnetic induction heating device 34 for the fixing belt 30 of the fourth example based on the control section 24A of the control device 24 is set to raise the temperature distribution in the width direction of the fixing belt 30 of the fourth example for about 10 degrees centigrade. As a result, the control section 24A of the control device 24 maintains the abnormality detection temperature of each of the temperature detection devices 42A and 42C at two sides at 210 degrees centigrade.

FIG. 10 shows the relation between the initial temperature distribution in the width direction in each of the fixing belts 30 of the first-fourth examples and the fixing belt 30 serving as the ideal standard belt assembled in the fixing device 16 shown in FIG. 2 for the first time and the corresponding abnormality detection temperature set in the plurality of temperature detection devices 42A, 42B and 42C. FIG. 10 further shows the relation between the initial temperature distribution in the width direction in each of two fixing belts (not shown) and the corresponding abnormality detection temperature set in the plurality of temperature detection devices 42A, 42B and 42C. In addition, the initial temperature distribution in the width direction in the two fixing belts (not shown) is contrary to that in the fixing belts 30 of the first and the second examples shown in FIG. 6 and FIG. 7, that is, the one side in the two fixing belts (not shown) corresponds to the other side in the fixing belts 30 of the first and the second examples shown in FIG. 6 and FIG. 7.

As can be seen from FIG. 10, in a case of the initial temperature distribution in the width direction in each of the two fixing belts (not shown) which is contrary (in the one side and the other side) to the initial temperature distribution in the width direction in the fixing belts 30 of the first and the second examples shown in FIG. 6 and FIG. 7, the setting of the corresponding abnormality detection temperature set in the plurality of temperature detection devices 42A, 42B and 42C is also contrary (in the one side and the other side) to the fixing belts 30 of the first and the second examples shown in FIG. 6 and FIG. 7.

The method according to the embodiment when assembling a new fixing belt 30 in the fixing device 16 according to the embodiment described above is mainly as follows with reference to FIG. 11.

The fixing belt 30 is supported at the given position of the fixing device 16 so that the fixing belt 30 is capable of annularly rotating on the pressing roller 32 (ST 1).

The fixing belt 30, when being annularly rotated for the first time on the pressing roller 32, is heated by the electromagnetic induction heating device 34 through the given output (ST 2).

The control section 24A of the control device 24 detects the heat generation temperature of the fixing belt 30 through the plurality of temperature detection devices 42A, 42B and 42C, and measures the distribution of the heat generation temperature in the longitudinal direction and the width direction of the fixing belt 30 on the basis of the temperature signal corresponding to the heat generation temperature (ST 3).

The control device 24 controls the output supplied for the electromagnetic induction heating device 34 on the basis of the distribution of the measured heat generation temperature and controls the initial distribution of the heat generation temperature in the given range (ST 4).

Then, the storage section 24B of the control device 24 stores the control of the output (ST 5).

Figure 11:
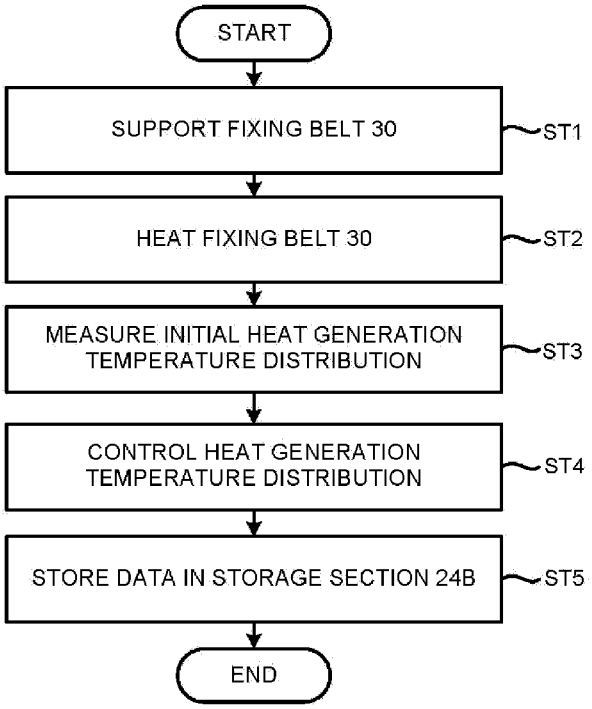
FIG. 11 is a flowchart schematically illustrating a method for controlling the temperature of the fixing belt of the fixing device shown in FIG. 2.
Figure 12:
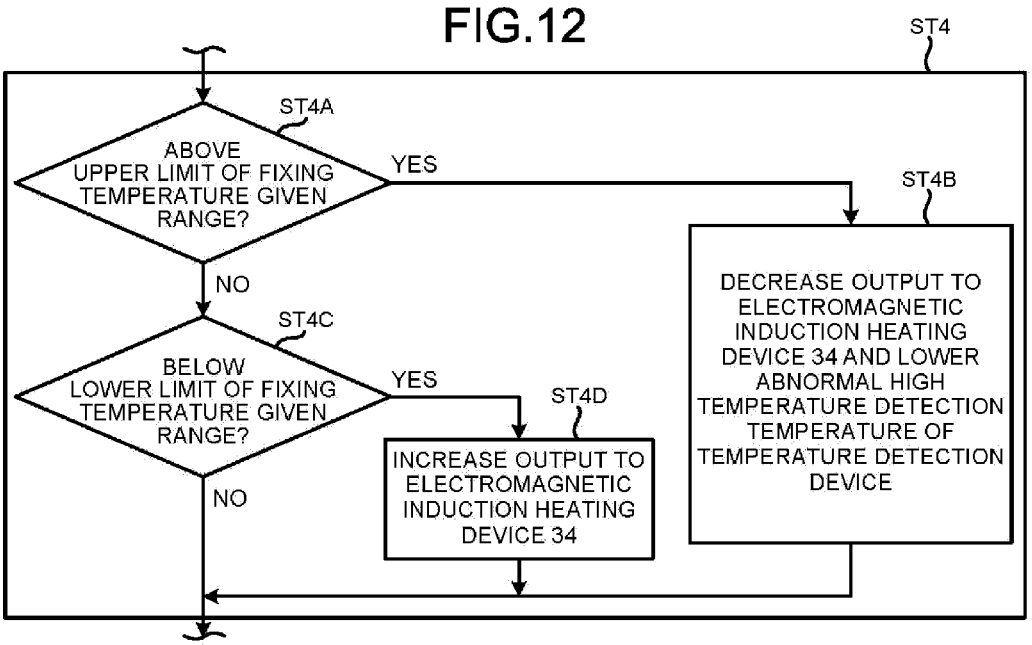
FIG. 12 is a flowchart illustrating an example of the content of a block ST 4 in the flowchart shown in FIG. 11 in detail.

FIG. 12 is a diagram illustrating one example of the content of ST 4 in FIG. 11 in detail. Herein, it is confirmed whether or not there is a value greater than the upper limit value of the fixing temperature range in the initial heat generation temperature distribution measured in ST 3 (ST 4A). In the embodiment described, the upper limit of the fixing temperature range is about 200 degrees centigrade.

If there is a value greater than the upper limit value of the fixing temperature range in the temperatures in the initial heat generation temperature distribution, the control section 24A of the control device 24 decreases the output to the electromagnetic induction heating device 34 from the given output to make the value greater than the upper limit value in the initial heat generation temperature distribution smaller than the upper limit value. At this time, the control section 24A of the control device 24 controls the decrease of the output to the electromagnetic induction heating device 34 to avoid that the lower limit value of the initial heat generation temperature distribution becomes smaller than the lower limit value of the fixing temperature range. At the same time, the control section 24A of the control device 24 lowers, for a temperature corresponding to the decrease amount of the temperature of the heat generation temperature distribution, the abnormal high temperature detection temperature in the temperature detection device which measured the value greater than the upper limit value of the fixing temperature range in the initial heat generation temperature distribution (ST 4B).

In ST 4A, if there is no value greater than the upper limit value of the fixing temperature range in the temperatures in the initial heat generation temperature distribution, next, it is confirmed whether or not there is a value smaller than the lower limit value of the fixing temperature range in the initial heat generation temperature distribution (ST 4C). In the embodiment described above, the lower limit of the fixing temperature range is about 150 degrees centigrade.

If there is a value smaller than the lower limit value of the fixing temperature range in the initial heat generation temperature distribution, the control section 24A of the control device 24 increases the output to the electromagnetic induction heating device 34 from the given output to make the value smaller than the lower limit value in the initial heat generation temperature distribution greater than the lower limit value. At this time, the control section 24A of the control device 24 controls the increase of the output to the electromagnetic induction heating device 34 to avoid that the upper limit value of the initial heat generation temperature distribution becomes greater than the upper limit value of the fixing temperature range (ST 4D).

In addition, the given range of the heat generation temperature of the fixing belt 30 can be arbitrarily changed according to different designs.

In the embodiment described above, the entire fixing belt 30 in the width direction is heated by one electromagnetic induction heating device 34, however, it is also applicable that the width direction is divided into a plurality of parts corresponding to the plurality of temperature detection devices, and the plurality of parts are heated by a plurality of electromagnetic induction heating devices, respectively. In this way, compared with the plurality of fixing belts 30 of which the temperature distributions in the width direction are different from each other when the entire width direction is heated by one electromagnetic induction heating device 34, the output to the plurality of electromagnetic induction heating devices can be controlled by the control device 24 so that the temperature distribution of each of such a plurality of fixing belts 30 becomes closer to a desired constant.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A method for controlling a temperature of a fixing belt assembled in a fixing device, the fixing belt being configured to generate heat through electromagnetic induction and being supported to be annularly rotatable in the fixing device, and the fixing device comprising the fixing belt, a pressing roller configured to contact with the fixing belt, a rotation drive source configured to rotate at least one of the fixing belt and the pressing roller, an electromagnetic induction heating device arranged adjacent to the fixing belt, a plurality of temperature detection devices arranged in a width direction of the fixing belt to separate from each other and configured to measure the temperature of the fixing belt and to send temperature signals corresponding to the measured temperature, and a control device including a storage section and a control section and connected with the plurality of temperature detection devices and the electromagnetic induction heating device, the method including:

heating the fixing belt by the electromagnetic induction heating device with a given output when the fixing belt is annularly rotated for the first time on the pressing roller;

measuring an initial distribution of heat generation temperature in the fixing belt by the control section of the control device on the basis of temperature signals corresponding to the heat generation temperature of the fixing belt outputted by the plurality of temperature detection devices;

controlling the output supplied for the electromagnetic induction heating device by the control section of the control device on the basis of the measured initial distribution of the heat generation temperature to control the distribution of the heat generation temperature in a given range;

storing the control of the output in the storage section of the control device; and controlling the output supplied for the electromagnetic induction heating device by the control section of the control device based on the control of the output stored in the storage section of the control device every time the fixing belt is rotated after the fixing belt is rotated for the first time.

2. A fixing device, comprising:

a fixing belt configured to be supported for an annular rotation in a longitudinal direction of the fixing belt and to generate heat by an electromagnetic induction;

a pressing roller configured to contact with the fixing belt;

a rotation drive source configured to rotate at least one of the fixing belt and the pressing roller in a given direction;

an electromagnetic induction heating device configured to be arranged adjacent to the fixing belt;

a plurality of temperature detection devices configured to be arranged to separate from each other in a width direction of the fixing belt, to measure the temperature of the fixing belt and to send temperature signals corresponding to the measured temperature; and a control device including a storage section and a control section and connecting with the plurality of temperature detection devices and the electromagnetic induction heating device;

wherein the control section of the control device is configured to supply a given output to the electromagnetic induction heating device to heat the fixing belt when the fixing belt is annularly rotated for the first time after the fixing belt is supported in the fixing device for the first time, to measure an initial distribution of heat generation temperature in the fixing belt on the basis of the temperature signals sent by the plurality of temperature detection devices and corresponding to the heat generation temperature of the fixing belt, and to control the output supplied for the electromagnetic induction heating device on the basis of the measured initial distribution of the heat generation temperature to control the distribution of the heat generation temperature in a given range;

the storage section of the control device is configured to store the control of the output; and the control section of the control device is further configured to control the output supplied for the electromagnetic induction heating device based on the control stored in the storage section every time the fixing belt is rotated after the rotation of the fixing belt for the first time.

3. The fixing device according to claim 2, wherein the electromagnetic induction heating device is arranged adjacent to an outer peripheral surface of the fixing belt at a position far away from the pressing roller; and the fixing device further comprises:

a magnetic shunt device and a magnetic shielding device, both of which correspond to the electromagnetic induction heating device and are arranged adjacent to an inner peripheral surface of the fixing belt at a position far away from the pressing roller, and a pressure pad configured to be arranged at a part of the inner peripheral surface of the fixing belt, the part being adjacent to the pressing roller.

4. The fixing device according to claim 2, wherein the fixing belt includes an inner substrate layer, a heat generation layer laminated around an outer peripheral surface of the inner substrate layer to generate heat by electromagnetic induction, and an elastic layer laminated around an outer peripheral surface of the heat generation layer.

5. The fixing device according to claim 4, wherein the heat generation layer is formed by plating conductive metal.

6. The fixing device according to claim 2, wherein the fixing belt is an endless belt.

7. An image forming apparatus comprising:

a medium supply section configured to supply a medium on which an image is to be formed;

an image forming section configured to form a desired image on the medium supplied from the medium supply section;

a fixing device configured to fix the desired image formed on the medium by the image forming section on the medium; and a medium discharge section configured to stack the medium discharged from the fixing device after the desired image is fixed on the medium by the fixing device;

wherein the fixing device includes:

a fixing belt configured to be supported for an annular rotation in a longitudinal direction of the fixing belt and to generate heat by an electromagnetic induction;

a pressing roller configured to contact with the fixing belt;

a rotation drive source configured to rotate at least one of the fixing belt and the pressing roller in a given direction;

an electromagnetic induction heating device configured to be arranged adjacent to the fixing belt;

a plurality of temperature detection devices configured to be arranged to separate from each other in a width direction of the fixing belt, to measure the temperature of the fixing belt and to send temperature signals corresponding to the measured temperature; and a control device including a storage section and a control section and connecting with the plurality of temperature detection devices and the electromagnetic induction heating device;

wherein the control section of the control device is configured to supply a given output to the electromagnetic induction heating device to heat the fixing belt when the fixing belt is annularly rotated for the first time after the fixing belt is supported in the fixing device for the first time, to measure an initial distribution of heat generation temperature in the fixing belt on the basis of the temperature signals sent by the plurality of temperature detection devices and being corresponding to the heat generation temperature of the fixing belt, and to control the output supplied for the electromagnetic induction heating device on the basis of the measured initial distribution of the heat generation temperature to control the distribution of the heat generation temperature in a given range;

the storage section of the control device is configured to store the control of the output; and the control section of the control device is further configured to control the output supplied for the electromagnetic induction heating device based on the control stored in the storage section every time the fixing belt is rotated after the rotation of the fixing belt for the first time.

8. The image forming apparatus according to claim 7, wherein the electromagnetic induction heating device of the fixing device is arranged adjacent to an outer peripheral surface of the fixing belt at a position far away from the pressing roller; and the fixing device further includes a magnetic shunt device and a magnetic shielding device, both of which correspond to the electromagnetic induction heating device and are arranged adjacent to an inner peripheral surface of the fixing belt at a position far away from the pressing roller, and a pressure pad configured to be arranged at a part of the inner peripheral surface of the fixing belt, the part being adjacent to the pressing roller.

9. The image forming apparatus according to claim 7, wherein the fixing belt includes an inner substrate layer, a heat generation layer laminated around an outer peripheral surface of the inner substrate layer to generate heat by electromagnetic induction, and an elastic layer laminated around an outer peripheral surface of the heat generation layer.

10. The image forming apparatus according to claim 9, wherein the heat generation layer is formed by plating conductive metal.

11. The image forming apparatus according to claim 7, wherein the fixing belt is an endless belt.

12. The image forming apparatus according to claim 7, wherein the image forming section includes a transfer member which has an outer surface contacting with a surface of the medium from the medium supply section and which rotates in a given direction, an image forming device configured to form the desired image on an outer surface of the transfer member, and a pressing roller which presses the medium against the outer surface of the transfer member while the surface of the medium is in contact with the outer surface of the transfer member, and which rotates in the same direction as a rotation direction of the outer surface of the transfer member to convey the medium to the fixing device in cooperation with the transfer member after the desired image formed on the outer surface of the transfer member is transferred to the surface of the medium.

13. The image forming apparatus according to claim 12, wherein the transfer member includes a transfer belt, and the image forming section includes a plurality of image forming devices configured to form a plurality of images having different colors on an outer surface of the transfer belt.

14. The method for controlling the temperature of a fixing belt according to claim 1, wherein the controlling of the output supplied for the electromagnetic induction heating device by the control section of the control device on the basis of the measured initial distribution of the heat generation temperature to control the distribution of the heat generation temperature in the given range includes:

deciding whether or not the measured initial distribution of the heat generation temperature is above an upper limit of a fixing temperature in a given range, by the fixing temperature an image formed on a medium being fixed on the medium in the fixing device;

controlling the output supplied for the electromagnetic induction heating device when it is decided that the measured initial distribution of the heat generation temperature includes a value which is above the upper limit of the fixing temperature in the given range, to lower the value which is above the upper limit under the upper limit and not to lower a lower limit of the measured initial distribution of the heat generation temperature under a lower limit of the fixing temperature in the given range;

deciding whether or not the measured initial distribution of the heat generation temperature includes a value which is under the lower limit of the fixing temperature in the given range when it is decided that the measured initial distribution of the heat generation temperature is under the upper limit of the fixing temperature in the given range; and controlling the output supplied for the electromagnetic induction heating device when it is decided that the measured initial distribution of the heat generation temperature includes a value which is under the lower limit of the fixing temperature in the given range, to rise the value which is under the lower limit of the fixing temperature above the lower limit of the fixing temperature and not to rise an upper limit of the measured initial distribution of the heat generation temperature above the upper limit of the fixing temperature in the given range.

15. The fixing device according to claim 2, wherein the controlling of the output supplied for the electromagnetic induction heating device by the control section of the control device on the basis of the measured initial distribution of the heat generation temperature to control the distribution of the heat generation temperature in the given range includes:

deciding whether or not the measured initial distribution of the heat generation temperature is above an upper limit of a fixing temperature in a given range, by the fixing temperature an image formed on a medium being fixed on the medium in the fixing device;

controlling the output supplied for the electromagnetic induction heating device when it is decided that the measured initial distribution of the heat generation temperature includes a value which is above the upper limit of the fixing temperature in the given range, to lower the value which is above the upper limit under the upper limit and not to lower a lower limit of the measured initial distribution of the heat generation temperature under a lower limit of the fixing temperature in the given range;

deciding whether the measured initial distribution of the heat generation temperature includes a value which is under the lower limit of the fixing temperature in the given range or not when it is decided that the measured initial distribution of the heat generation temperature is under the upper limit of the fixing temperature in the given range; and controlling the output supplied for the electromagnetic induction heating device when it is decided that the measured initial distribution of the heat generation temperature includes a value which is under the lower limit of the fixing temperature in the given range, to rise the value which is under the lower limit of the fixing temperature above the lower limit of the fixing temperature and not to rise an upper limit of the measured initial distribution of the heat generation temperature above the upper limit of the fixing temperature in the given range.

16. The image forming apparatus according to claim 7, wherein the controlling of the output supplied for the electromagnetic induction heating device by the control section of the control device on the basis of the measured initial distribution of the heat generation temperature to control the distribution of the heat generation temperature in the given range includes:

deciding whether or not the measured initial distribution of the heat generation temperature is above an upper limit of a fixing temperature in a given range, by the fixing temperature an image formed on a medium being fixed on the medium in the fixing device;

controlling the output supplied for the electromagnetic induction heating device when it is decided that the measured initial distribution of the heat generation temperature includes a value which is above the upper limit of the fixing temperature in the given range, to lower the value which is above the upper limit under the upper limit and not to lower a lower limit of the measured initial distribution of the heat generation temperature under a lower limit of the fixing temperature in the given range;

deciding whether or not the measured initial distribution of the heat generation temperature includes a value which is under the lower limit of the fixing temperature in the given range when it is decided that the measured initial distribution of the heat generation temperature is under the upper limit of the fixing temperature in the given range; and controlling the output supplied for the electromagnetic induction heating device when it is decided that the measured initial distribution of the heat generation temperature includes a value which is under the lower limit of the fixing temperature in the given range, to rise the value which is under the lower limit of the fixing temperature above the lower limit of the fixing temperature and not to rise an upper limit of the measured initial distribution of the heat generation temperature above the upper limit of the fixing temperature in the given range.

* * * * *